US011318469B2

(12) United States Patent
Shkolnikov et al.

(10) Patent No.: US 11,318,469 B2
(45) Date of Patent: May 3, 2022

(54) SELECTIVE RELEASE OF MATERIAL IN THERMALLY DEGRADABLE CAPSULE

(71) Applicant: HEWLETT-PACKARD DEVELOPMENT COMPANY, L.P., Spring, TX (US)

(72) Inventors: Viktor Shkolnikov, Palo Alto, CA (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/606,287

(22) PCT Filed: Apr. 25, 2018

(86) PCT No.: PCT/US2018/029368
§ 371 (c)(1),
(2) Date: Oct. 18, 2019

(87) PCT Pub. No.: WO2019/209290
PCT Pub. Date: Oct. 31, 2019

(65) Prior Publication Data
US 2021/0331165 A1 Oct. 28, 2021

(51) Int. Cl.
*B01L 3/00* (2006.01)
*B01L 7/00* (2006.01)

(52) U.S. Cl.
CPC ... *B01L 3/502746* (2013.01); *B01L 3/502761* (2013.01); *B01L 7/00* (2013.01);
(Continued)

(58) Field of Classification Search
CPC ..... B01L 3/502746; B01L 3/502761; B01L 7/00; B01L 2300/1827; B01L 2400/086; B01L 2200/0668
See application file for complete search history.

(56) References Cited

U.S. PATENT DOCUMENTS 5,695,942 A 12/1997 Farmilo et al.
6,989,210 B2 1/2006 Gore
(Continued)

FOREIGN PATENT DOCUMENTS

KR 20120035272 A 4/2012
WO WO2010022193 A3 5/2010
(Continued)

OTHER PUBLICATIONS

Esser-Kahn, Aaron P., et al.,Triggered Release from Polymer Capsules, Jul. 6, 2011, American Chemical Society.

*Primary Examiner* — Jennifer Wecker
(74) *Attorney, Agent, or Firm* — HP Inc. Patent Department

(57) ABSTRACT

An example system includes a microfluidic cavity; a retaining feature within the microfluidic cavity, and a releasing feature. The retaining feature is to position capsules at a predetermined location in the microfluidic cavity. The capsules have a thermally degradable shell enclosing a material therein. The releasing feature is to selectively cause degradation of the shell to release the material into the microfluidic opening. The releasing feature is to generate heat to facilitate degradation of the shell. In some examples, the retaining feature is a physical barrier sized to prevent flow of the capsule and to allow flow of the released materials through the microfluidic cavity.

15 Claims, 5 Drawing Sheets

(52) U.S. Cl.
CPC ..... *B01L 2200/0668* (2013.01); *B01L 2300/1827* (2013.01); *B01L 2400/086* (2013.01)

(56) References Cited

U.S. PATENT DOCUMENTS

| | | | | |
|---|---|---|---|---|
| 7,473,248 | B2 | 1/2009 | Santini et al. | |
| 8,506,906 | B2 | 8/2013 | Griss et al. | |
| 9,040,288 | B2 | 5/2015 | Handique et al. | |
| 2004/0214056 | A1 | 10/2004 | Gore | |
| 2006/0228734 | A1 * | 10/2006 | Vann ..... | G01N 33/54386 435/6.19 |
| 2015/0224466 | A1 | 8/2015 | Hindson et al. | |

FOREIGN PATENT DOCUMENTS

| | | | | |
|---|---|---|---|---|
| WO | WO-2011149032 | A1 * | 12/2011 | ..... B01L 3/502761 |
| WO | WO2017070056 | A1 | 4/2017 | |

* cited by examiner

SELECTIVE RELEASE OF MATERIAL IN THERMALLY DEGRADABLE CAPSULE

BACKGROUND

Microfluidic devices are increasingly commonplace in a variety of environments. For example, microfluidic devices have applicability in biology, medicine, genetics and numerous other fields. Microfluidic devices may include such devices as lab-on-a-chip micro-total analytical systems and can carry, analyze, or process various particles, bacteria, biological cells and other solid and soft objects of microscale. Various microfluidic devices may include fluids flowing through narrow channels. In a lab-on-a-chip, for example, blood cells may be moved from one chamber to another, such as from an input port to a reaction chamber. In other examples, the microfluidic device may be provided for the flow of other fluids or materials, such as blood or other biological fluids.

BRIEF DESCRIPTION OF THE DRAWINGS

For a more complete understanding of various examples, reference is now made to the following description taken in connection with the accompanying drawings in which.

DETAILED DESCRIPTION

As noted above, microfluidic devices may include fluids flowing through narrow channels. In various examples, the fluids may include reagents or other material to be released when desired. For example, an antibody or a nucleic acid segment may be released into a flow for testing or to facilitate testing. In this regard, the material to be released may be encapsulated in a capsule. When desired, the capsule may be opened to release the material therein. Mechanical opening of capsules, such as with a plunger, may use significant volume for the mechanical components. Further, manually opening of the capsules by a user may use valuable human resources.

Various examples described herein relate to controlling the positioning of capsules and selectively releasing material, such as biological material, from the capsules. In various examples, the capsules are formed with a thermally degradable shell containing the material therein. The thermally degradable shell may be formed of a material such as wax, for example. An example system includes a retaining feature in a microfluidic cavity, such as a reservoir or a channel. Various examples of retaining features include physical barriers such as pillars, weirs or meshes which restrict movement of the capsule, but allow movement of the material when released from the capsules. Various example systems are provided with a releasing feature to selectively release the material contained within the shell of the capsule.

The releasing feature generates heat to selectively cause degradation of the shell to release the material into the microfluidic opening. For example, the releasing feature may be resistor which generates heat to at least partly melt the wax shell, thereby allowing the material therein to escape.

Figure 1:
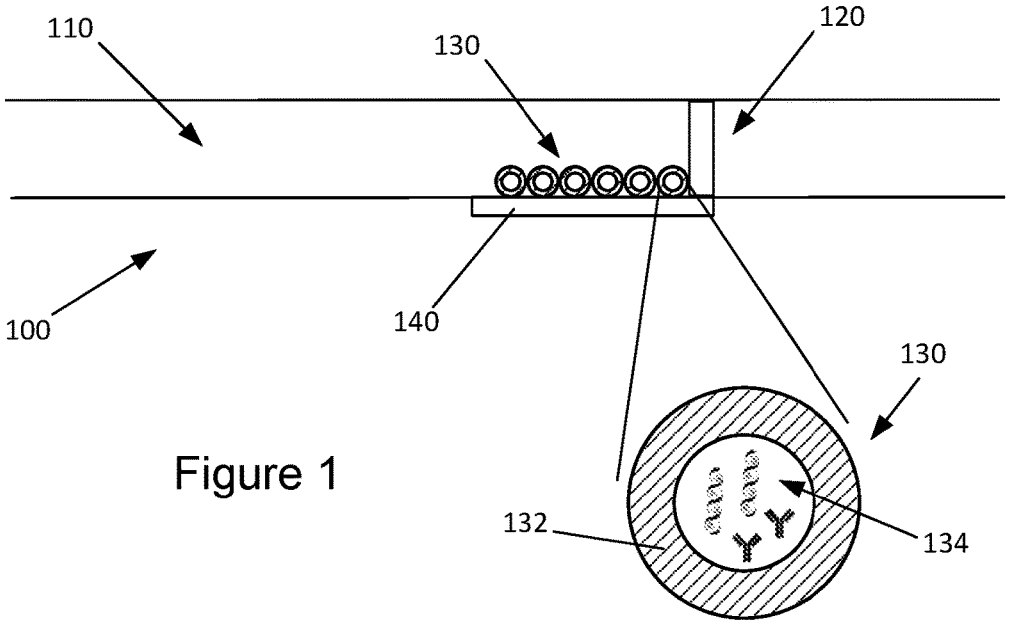
FIG. 1 illustrates an example system for selective release of material in thermally degradable capsules.

Referring now to the Figures, FIG. 1 illustrates an example system 100 for selective release of material in thermally degradable capsules. In various examples, the example system 100 may be implemented as a lab-on-a-chip or a part thereof. The example system 100 of FIG. 1 includes a microfluidic cavity 110 which may accommodate particles or fluid therein. In various examples, the cavity 110 may be a microfluidic channel or a tank (e.g., reservoir). In one example, the cavity 110 is a microfluidic channel with a cross-sectional width of between about 10 μm and about 500 μm.

The example system 100 is provided with a retaining feature 120 within the microfluidic cavity 110. The retaining feature 120 is provided to position capsules 130 at a predetermined location in the microfluidic cavity 110. As illustrated in the example of FIG. 1, the capsules 130 include a shell 132 enclosing material 134 therein. The shell 132 is formed of a thermally degradable material, such as wax or a polymer. The thermally degradable material may be selected based on a variety of factors, such as the melting point of the thermally degradable material. In various examples, the thermally degradable material used for the shell 132 may be icosane ($C_{20}H_{42}$), triacontane ($C_{30}H_{62}$), tetracontane ($C_{40}H_{82}$), pentacontane ($C_{54}H_{102}$), hexacontane ($C_{60}H_{122}$), or a combination thereof. The material 134 in the shell 132 may include any of a variety of materials such as a reagent, antibody, nucleic acid fragment, or a combination thereof, for example. In various examples, the material 134 may be provided in an aqueous solution.

In various examples, as described below, the retaining feature 120 may be a mechanical barrier sized to prevent flow of the capsule 130 through the barrier. The retaining feature 120 may be provided with openings or spacing to allow flow of the material 134 through the microfluidic cavity when the material 134 is released from the capsule 130. Various examples of retaining feature 120 are described below with reference to FIGS. 2-4.

To facilitate release of the material 134 from the capsules 130, the example system 100 of FIG. 1 is provided with a releasing feature 140. The releasing feature 140 of FIG. 1 is to selectively cause degradation of the shell 132 of the capsule 130, thus releasing the material 134 into the microfluidic cavity 110. In this regard, the releasing feature 140 generates thermal energy (e.g., heat) to facilitate degradation of the shell 132, with the shell 132 formed of a thermally degradable material. The releasing feature of the example system 100 of FIG. 1 is positioned adjacent to the retaining feature 120 substantially at the predetermined position for retaining the capsules.

Figure 2:
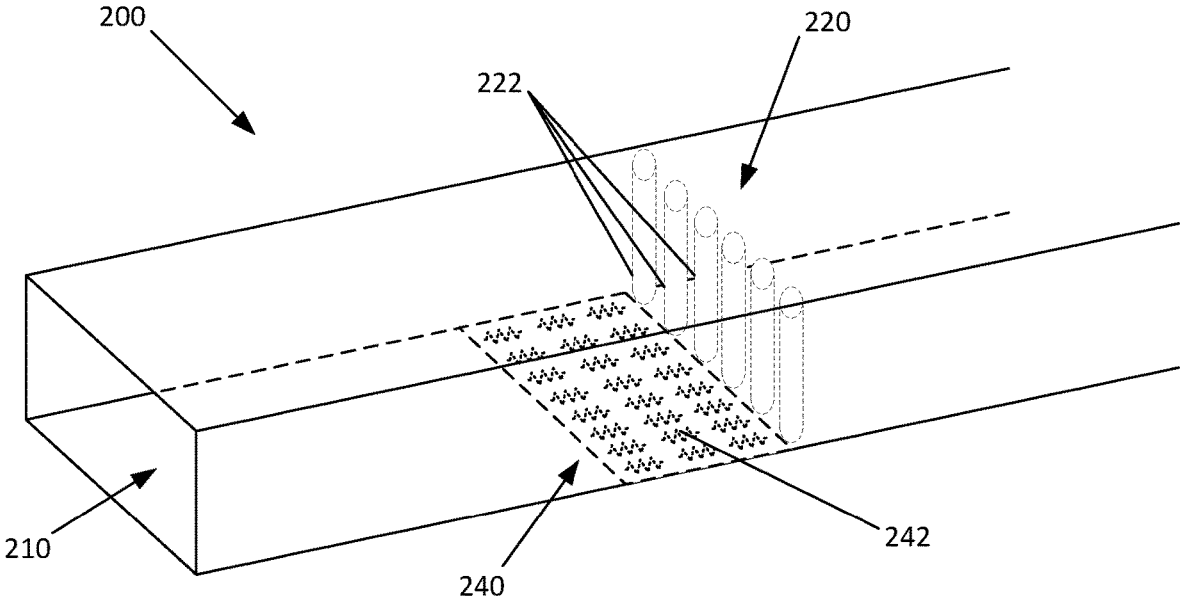
FIGS. 2-4 illustrate perspective views of other example systems for selective release of material in thermally degradable capsules.

Referring now to FIG. 2, a perspective view of another example system 200 for selective release of material in thermally degradable capsules is illustrated. The example system 200 is similar to the example system 100 of FIG. 1 and includes a microfluidic cavity 210. As noted above, the microfluidic cavity 210 may be a channel or a reservoir. The example system 200 of FIG. 2 further includes a retaining feature 220 and a releasing feature 240. As noted above, the retaining feature 220 is provided to position capsules (not shown in FIG. 2) at a predetermined location in the microfluidic cavity 210. In the example system 200 of FIG. 2, the retaining feature 220 includes a set of pillars 222. In one example, the pillars 222 extend the entire height of the microfluidic cavity 210, as illustrated in FIG. 2. In other examples, the pillars 222 may extend up to a predetermined height that is less than the entire height of the microfluidic cavity 210.

The pillars 222 are separated by a gap between adjacent pillars 222. The size of the gap is selected to be sufficiently small to prevent the capsules from passing through. For example, the gap may be selected to be a size smaller than the diameter of the capsules. Further, the gap is sized to allow the material enclosed in the capsules to pass through when the material is released from the capsules.

As noted above, the releasing feature 240 is provided to selectively cause degradation of the shell of the capsule by generating thermal energy. In various examples, as illustrated in FIG. 2, the releasing feature 240 includes at least one resistor 242. When activated, the resistor 242 generates heat to cause degradation of the thermally degradable shell of capsules positioned above the releasing feature 240. In some examples, the releasing feature 240 includes a single resistor. In other examples, as illustrated in FIG. 2 the releasing feature includes an array of resistors 242. As described below with reference to FIGS. 8-10, thermal energy from the releasing feature 240 causes degradation of the shell of the capsule, allowing the material enclosed in the shell to be released into the microfluidic cavity 210.

Figure 3:
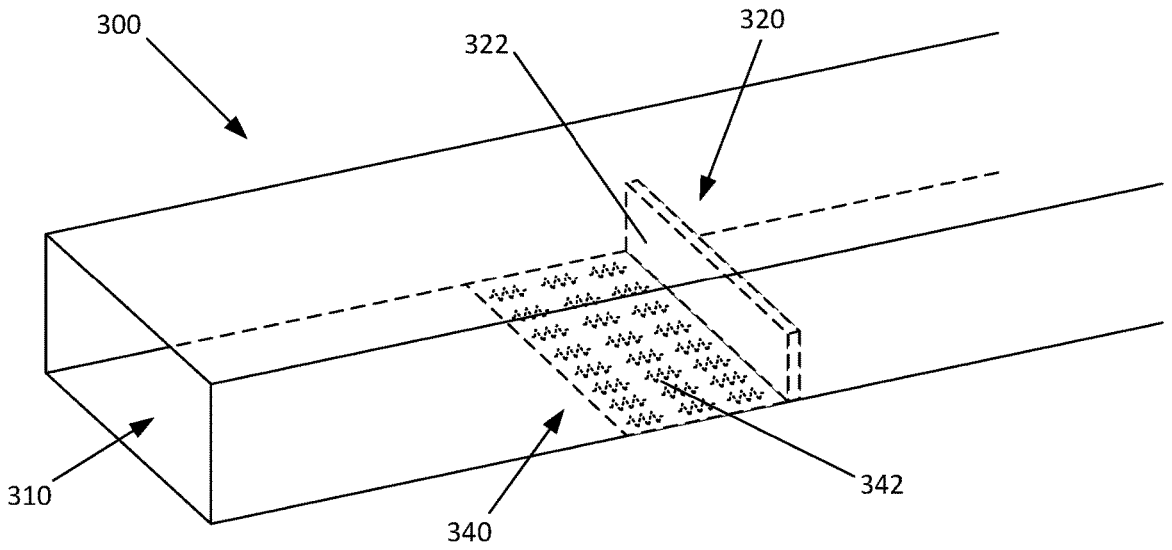

Referring now to FIG. 3, a perspective view of another example system 300 for selective release of material in thermally degradable capsules is illustrated. The example system 300 is similar to the example system 200 of FIG. 2 and includes a microfluidic cavity 310 and a releasing feature 340 with an array of resistors 342. The example system 300 of FIG. 3 further includes a retaining feature 320. In the example system 300 of FIG. 3, the retaining feature 320 includes a weir 322. As illustrated in FIG. 3, the weir 322 extends substantially the entire width of the microfluidic cavity 310. In this regard, the weir 322 may be a wall that prevents capsules from passing to the sides of the weir 322. As illustrated in the example of FIG. 3, the weir 322 extends only part of the height of the microfluidic cavity 310. Thus, capsules may be positioned as sediment in the predetermined position (e.g., above the releasing feature 440). When the material within the capsules is released, the material may pass over the weir through the microfluidic cavity 310.

Figure 4:
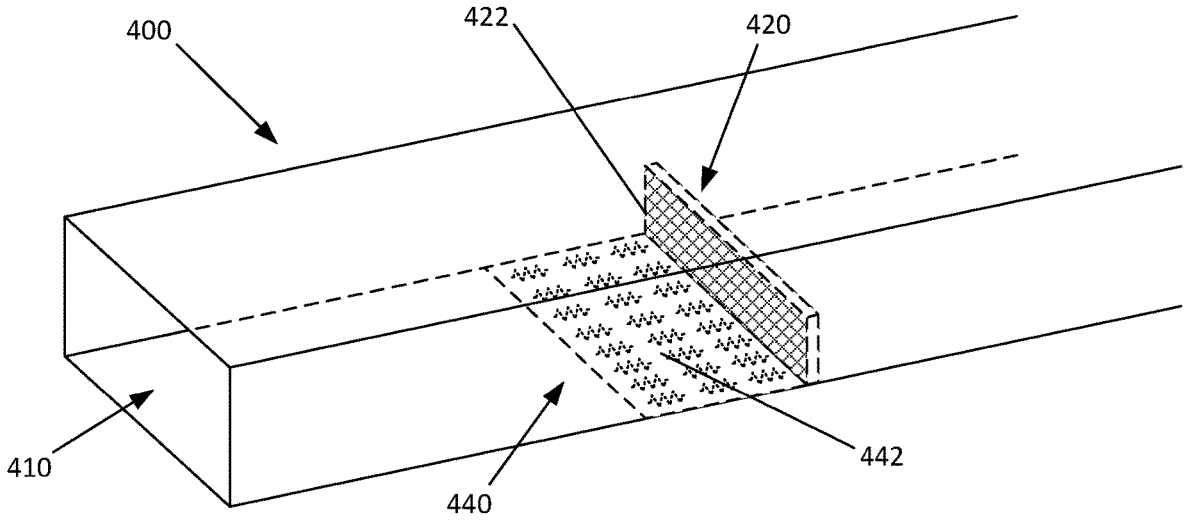

Referring now to FIG. 4, a perspective view of another example system 400 for selective release of material in thermally degradable capsules is illustrated. The example system 400 is similar to the example systems 200, 300 of FIGS. 2 and 3, respectively, and includes a microfluidic cavity 410 and a releasing feature 440 with an array of resistors 442. The example system 400 of FIG. 4 further includes a retaining feature 420. In the example system 400 of FIG. 4, the retaining feature 420 includes a mesh 422. As illustrated in FIG. 4, the mesh 422 extends substantially the entire width of the microfluidic cavity 410 to prevent capsules from passing to the sides of the mesh 422. As illustrated in the example of FIG. 4, the mesh 422 extends only part of the height of the microfluidic cavity 410. In other examples, the mesh 422 may extend the entire height of the microfluidic cavity 410.

In various examples, the mesh 422 is provided with openings that are small than the diameter of the capsules. Thus, the mesh 422 prevents the capsules from passing through. The openings are sufficiently large to allow the material encapsulated in the capsules from passing through when the material is released from the capsules.

Figure 5:
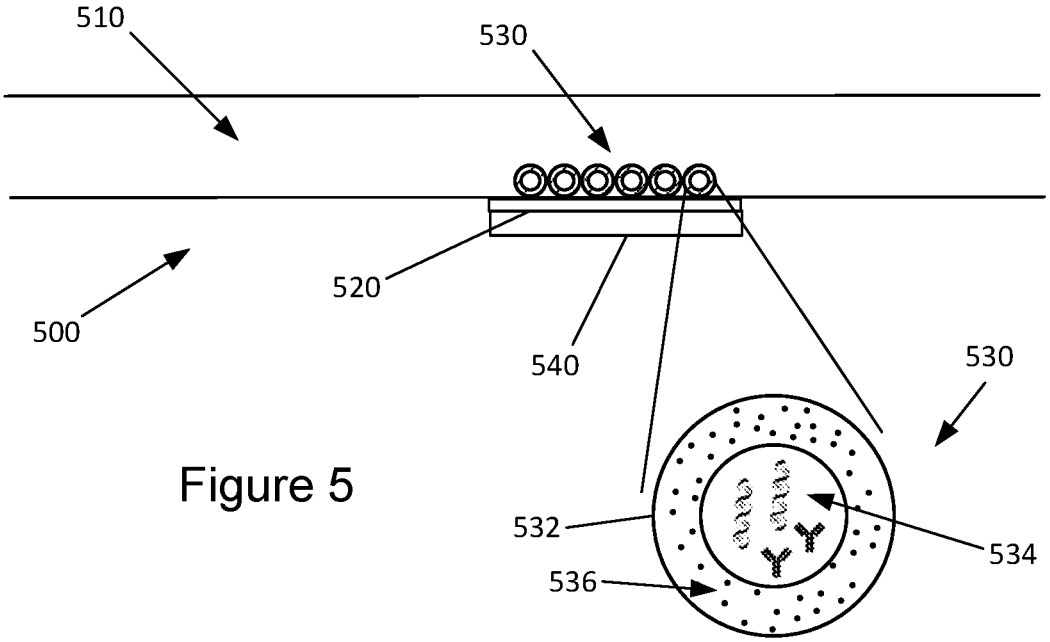
FIGS. 5-7 illustrate side views of other example systems for selective release of material in thermally degradable capsules.

Referring now to FIG. 5, a side view of another example system 500 for selective release of material in thermally degradable capsules is illustrated. The example system 500 of FIG. 5 includes a microfluidic cavity 510 which may accommodate particles or fluid therein. The example system 500 further includes a retaining feature 520 for positioning capsules 530 in a predetermined location and a releasing feature 540 to release material 534 encapsulated in a shell 532 of the capsules 530. Similar to the examples systems described above, the releasing feature may include a resistor, or an array of resistors, to generate thermal energy to degrade the thermally degradable shell of the capsules 530.

The retaining feature 520 of the example system 500 of FIG. 5 includes a magnet (e.g., electromagnet) positioned above the releasing feature 540. In this regard, the retaining feature 520 uses magnetic forces to selectively position the capsules 530 at the predetermined location in the microfluidic cavity 510. In the example system 500 of FIG. 5, the capsules 530 are provided with metal nanoparticles 536 embedded within the thermally degradable shell 532. Thus, as the capsules 530 are flowed through the microfluidic cavity, the metal nanoparticles 536 are attracted by the magnet of the retaining feature 520, thus positioning the capsules 530 at the retaining feature 520.

Figure 6:
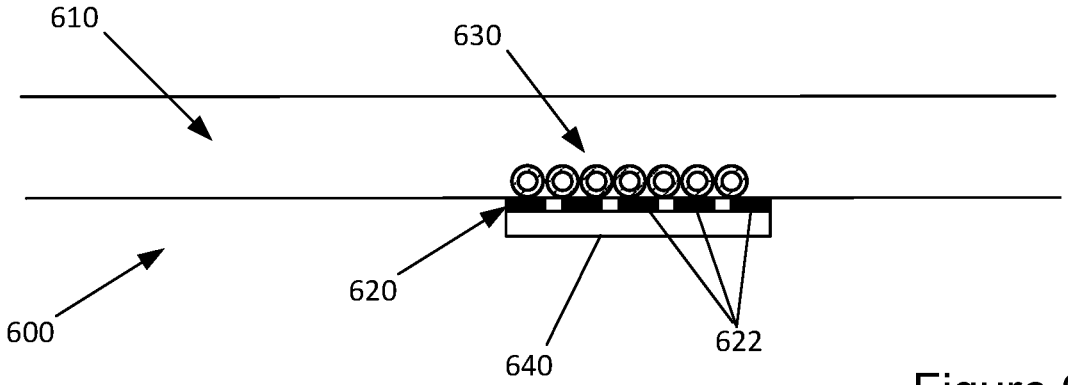

Referring now to FIG. 6, a side view of another example system 600 for selective release of material in thermally degradable capsules is illustrated. The example system 600 of FIG. 6 includes a microfluidic cavity 610 which may accommodate particles or fluid therein. The example system 600 further includes a retaining feature 620 for positioning capsules 630 in a predetermined location and a releasing feature 640 to release material encapsulated in a shell of the capsules 630. Similar to the examples systems described above, the releasing feature may include a resistor, or an array of resistors, to generate thermal energy to degrade the thermally degradable shell of the capsules 630.

The retaining feature 620 of the example system 600 of FIG. 6 includes a set of dielectrophoreses (DEP) electrodes 622. The DEP force generated by the DEP electrodes 622 is selected to be sufficient to attract the capsules 630. The DEP electrodes 622 are spaced apart within the predetermined location at which the capsules 630 are to be positioned.

Figure 7:
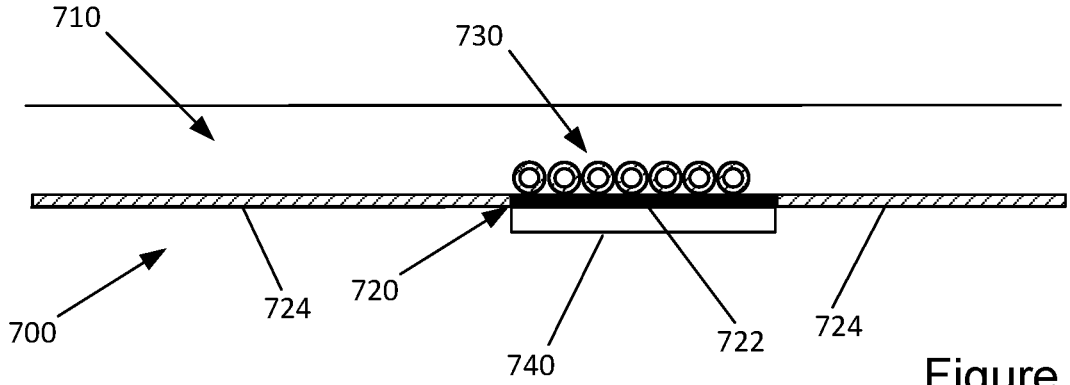

Referring now to FIG. 7, a side view of another example system 700 for selective release of material in thermally degradable capsules is illustrated. The example system 700 of FIG. 7 includes a microfluidic cavity 710 which may accommodate particles or fluid therein. The example system 700 further includes a retaining feature 720 for positioning capsules 730 in a predetermined location and a releasing feature 740 to release material encapsulated in a shell of the capsules 730. Similar to the examples systems described above, the releasing feature may include a resistor, or an array of resistors, to generate thermal energy to degrade the thermally degradable shell of the capsules 730.

The retaining feature 720 of the example system 700 of FIG. 7 includes a hydrophobic surface 722. The hydrophobic surface 722 has a low surface energy to which the thermally degradable material (e.g., wax) of the shell of the capsules attaches. In one example, as illustrated in FIG. 7, the hydrophobic surface 722 is surrounded by a hydrophilic surface 724. Thus, the difference in the surface energy between the hydrophobic surface 722 and the hydrophilic surface 724 is increased, enhancing the settling of the capsules 730 to the hydrophobic surface 722.

Figure 8:
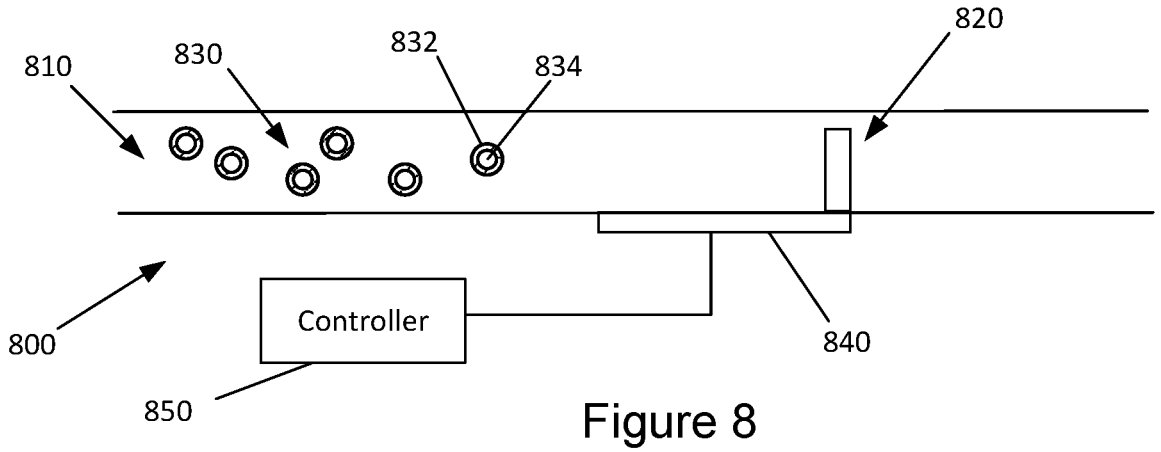
FIGS. 8-10 illustrate selective release of material in thermally degradable capsules in an example system.
Figure 9:
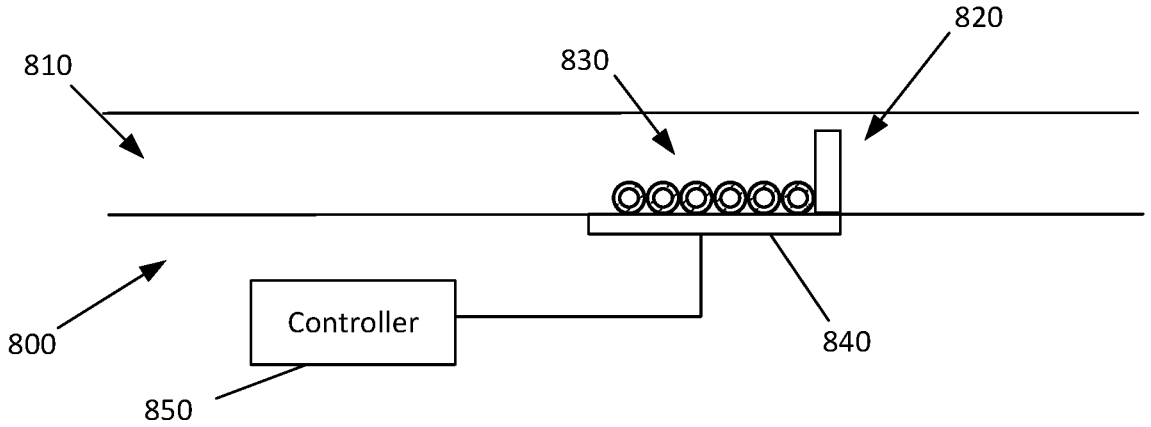
Figure 10:
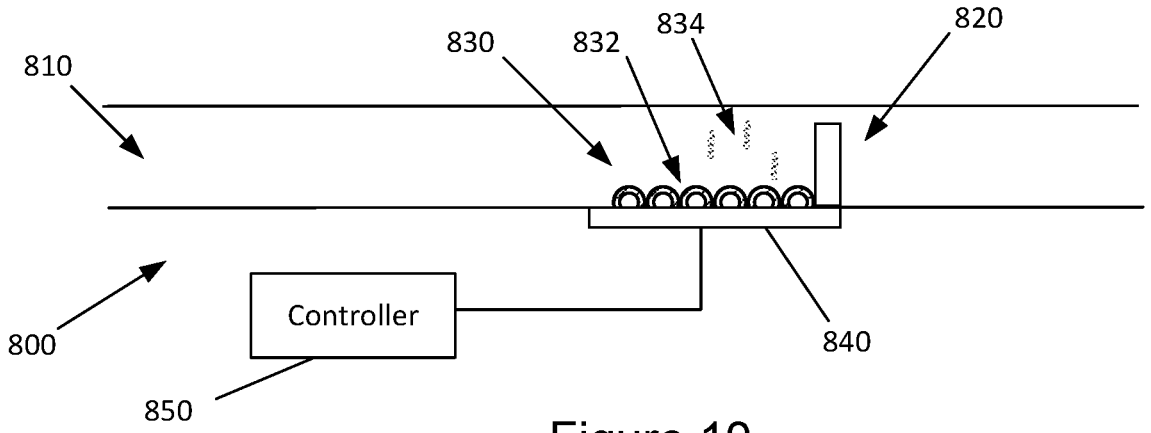

Referring now to FIGS. 8-10, selective release of material in thermally degradable capsules in an example system 800 is illustrated. The example system 800 of FIGS. 8-10 is similar to the system 100 described above with reference to FIG. 1. The example system 800 includes a microfluidic cavity 810, a retaining feature 820, and a releasing feature 840. As noted above, the retaining feature 820 is provided to position capsules 830 at a predetermined location in the microfluidic cavity 810. In the example system 800 of FIG. 8, the retaining feature 820 includes a mechanical feature such as pillars, weir or mesh, for example. The example system 800 of FIGS. 8-10 is further provided with a controller 850. In various examples, the controller 850 may selectively activate the releasing feature 840, as described below with reference to FIGS. 8-10.

Referring first to FIG. 8, capsules 830 are directed into the microfluidic cavity 810. As described above, the capsules include a shell 832 encapsulating material 834. The material 834 may include biological material, such as antibodies, reagents, or nucleic acid segments, for example. The shell 832 is formed of a thermally degradable material, such as wax or a polymer material, for example. As the capsules 830 are directed into the microfluidic cavity 810, the controller 850 may maintain the releasing feature 840 in a deactivated condition.

As illustrated in FIG. 9, the retaining feature 820 causes the capsules 830 to settle, or sediment, at the predetermined location, adjacent to the retaining feature in the example system 800. The controller 850 may maintain the releasing feature 840 in a deactivated condition. In some examples, the controller 850 may move the releasing feature 840 to a low-power condition. In this regard, the releasing feature 840 (e.g., resistor) may generate a small amount of thermal energy. The small amount of thermal energy may be sufficient to facilitate bonding of the thermally degradable shell 832 of the capsules 830 to the surface of the microfluidic cavity 810.

Referring now to FIG. 10, the controller 850 causes the releasing feature 840 to be activated or moved to a high-power condition. In this mode, as illustrated in FIG. 10, the thermal energy generated by the releasing feature 840 sufficiently degrades the thermally degradable shell 832 of the capsules 830 to cause the material 834 therein to be released into the microfluidic cavity 810. As noted above with reference to FIGS. 1-4, the retaining feature 820 is sized to allow the released material 834 to pass through. While the material 834 passes through the retaining feature 820, the degraded shell 832 (e.g., melted wax) remains on the surface of the microfluidic cavity 810.

Figure 11:
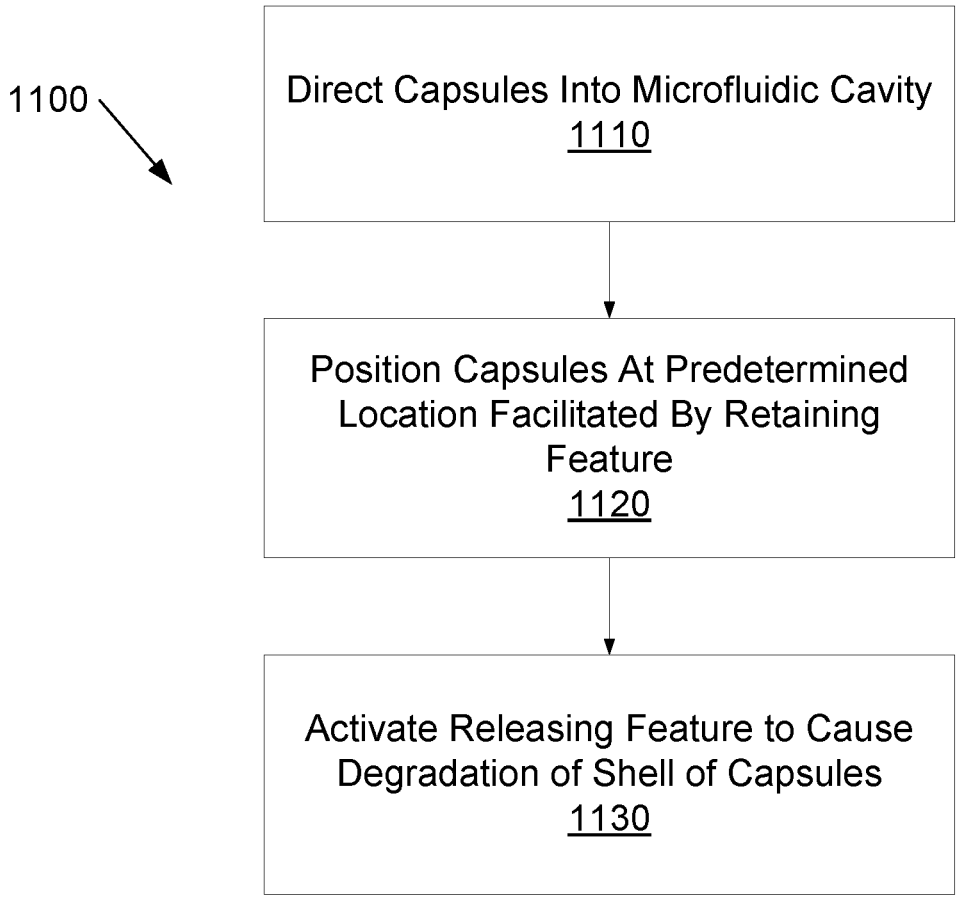
FIG. 11 is a flow chart illustrating an example method for selective release of material in thermally degradable capsules in an example system.

Referring now to FIG. 11, a flow chart illustrating an example method 1100 for selective release of material in thermally degradable capsules in an example system is illustrated. The example method 1100 may be implemented in a system such as the example system 800 described above with reference to FIGS. 8-10. The example method 1100 includes directing capsules into a microfluidic cavity (block 1110). For example, as illustrated in FIG. 8, capsules 830 are directed into the microfluidic cavity 810. As noted above, the capsules include a shell formed of a thermally degradable material (e.g., wax) encapsulating biological material.

The example method 1100 further includes positioning the capsules at a predetermined location in the microfluidic cavity (block 1120). As described above, the positioning of the capsules being facilitated by a retaining feature. The retaining feature may be a mechanical barrier, such as a set of pillars (as illustrated in FIG. 2), a weir (as illustrated in FIG. 3) or a mesh (as illustrated in FIG. 4). In other examples, the retaining feature may be a non-mechanical feature, such as a set of dielectrophoreses electrodes (as illustrated in FIG. 6) or a hydrophobic region surrounded by hydrophilic regions (as illustrated in FIG. 7).

The example method 1100 further includes activating a releasing feature (block 1130). Activation of the releasing feature generates heat to selectively cause degradation of the shell of the capsules, thus releasing the biological material therein. As described above, in various examples, the releasing feature may include a resistor which generates thermal energy when activated.

Thus, the example systems described above provide for efficient control of releasing of biological material in capsules. Various examples described herein facilitate release of the biological material with minimal or no manual involvement.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

a microfluidic cavity defined by at least one wall;

a plurality of capsules configured to flow through the microfluidic cavity along an axis aligned with the at least one wall, the plurality of capsules having a thermally degradable shell enclosing a material therein;

a retaining feature within the microfluidic cavity, configured to position the plurality of capsules at a predetermined location in the microfluidic cavity; and a releasing feature configured to selectively cause degradation of the shell to release the material into the microfluidic cavity, the releasing feature to generate heat to facilitate degradation of the shell, wherein the retaining feature is a mechanical barrier sized and configured to prevent flow of the plurality of capsules through the microfluidic cavity along the axis aligned with the wall of the microfluidic cavity and to allow flow of the released materials through the microfluidic cavity.

2. The system of claim 1, wherein the retaining feature is at least one of a set of pillars, a weir, or a mesh.

3. The system of claim 1, wherein the retaining feature is a mesh with openings smaller than each of the plurality of capsules and larger than the material within the plurality of capsules.

4. The system of claim 1, wherein the releasing feature is a resistor to generate heat when activated.

5. The system of claim 1, wherein the microfluidic cavity is one of a channel or a reservoir.

6. The system of claim 1, wherein the thermally degradable shell is formed of a wax or polymer material.

7. A system, comprising:

a microfluidic cavity defined by at least one wall;

a plurality of capsules configured to flow through the microfluidic cavity along an axis aligned with the at least one wall, the plurality of capsules having a thermally degradable shell enclosing a material therein;

a retaining feature within the microfluidic cavity, configured to position the plurality of capsules at a predetermined location in the microfluidic cavity; and a releasing feature configured to selectively cause degradation of the shell to release the material into the microfluidic cavity, the releasing feature to generate heat to facilitate degradation of the shell, wherein the retaining feature is configured to prevent flow of the material enclosed inside the plurality of capsules through the microfluidic cavity along the axis aligned with the wall of the microfluidic cavity, the retaining feature including:

a hydrophobic region surrounded by hydrophilic regions, or a set of dielectrophoreses electrodes.

8. The system of claim 7, wherein the releasing feature is a resistor to generate heat when activated.

9. The system of claim 7, wherein the thermally degradable shell is formed of a wax or polymer material.

10. A method, comprising:

directing capsules to flow through a microfluidic cavity along an axis aligned with the at least one wall of the microfluidic channel, the capsules having shell formed of a thermally degradable material encapsulating a material therein;

positioning the capsules at a predetermined location in the microfluidic cavity, the positioning of the capsules being facilitated by a retaining feature, the retaining feature including at least one of (a) a mechanical barrier, (b) a hydrophobic region surrounded by hydrophilic regions, or (c) a set of dielectrophoreses electrodes; and wherein the retaining feature is configured to prevent flow of the plurality of capsules through the microfluidic cavity along the axis aligned with the wall of the microfluidic cavity and to allow flow of the released materials through the microfluidic cavity;

activating a releasing feature, the releasing feature generating heat to selectively cause degradation of the shell to release the material into the microfluidic cavity.

11. The method of claim 10, wherein the retaining feature is at least one of a set of pillars, a weir, or a mesh.

12. The method of claim 10, wherein the retaining feature is a mesh with openings smaller than each of the plurality of capsules and larger than the material within the plurality of capsules.

13. The method of claim 10, wherein the releasing feature is a resistor to generate heat when activated.

14. The method of claim 10, wherein the microfluidic cavity is one of a channel or a reservoir.

15. The method of claim 10, wherein the thermally degradable shell is formed of a wax or polymer material.

* * * * *